US005553739A

United States Patent [19]

Plum et al.

[11] Patent Number: 5,553,739

[45] Date of Patent: Sep. 10, 1996

[54] TABLET DISPENSER

[75] Inventors: Thomas Munk Plum, Skodsborg; Kim Steengaard, Hvidovre; Jens Møller-Jensen, Copenhagen, all of Denmark

[73] Assignee: Novo Nordisk A/S, Bagsvaerd, Denmark

[21] Appl. No.: 244,572

[22] PCT Filed: Dec. 2, 1992

[86] PCT No.: PCT/DK92/00361

§ 371 Date: Jun. 9, 1994

§ 102(e) Date: Jun. 9, 1994

[87] PCT Pub. No.: WO93/11057

PCT Pub. Date: Jun. 10, 1993

[30] Foreign Application Priority Data

Dec. 5, 1991 [DK] Denmark ..... 1963/91

[51] Int. Cl.[6] ..... G07F 11/18

[52] U.S. Cl. ..... 221/196; 221/243; 221/263; 221/264

[58] Field of Search ..... 221/185, 243, 221/263, 264, 156, 161, 203, 195, 196, 197

[56] References Cited

U.S. PATENT DOCUMENTS

| | | | |
|---|---|---|---|
| 1,607,014 | 11/1926 | Moak | 221/264 X |
| 2,669,349 | 2/1954 | Silver | 221/203 X |
| 2,774,470 | 12/1956 | Q'Part | 221/264 X |
| 3,332,576 | 7/1967 | Hamilton | 221/202 |
| 4,354,619 | 10/1982 | Wippermann et al. | 221/263 |
| 4,415,098 | 11/1983 | Haas | 221/202 |
| 4,492,316 | 1/1985 | Emms | 221/202 |
| 5,174,471 | 12/1992 | Kozlowski et al. | 221/263 X |

FOREIGN PATENT DOCUMENTS 2921186 11/1980 Germany .

*Primary Examiner*—William E. Terrell
*Assistant Examiner*—Dean A. Reichard
*Attorney, Agent, or Firm*—Steve T. Zelson; Elias J. Lambiris

[57] ABSTRACT

The present invention relates to a dispenser for tablets, comprising a drawer element having a through going opening for the accommodation of just one tablet, which drawer element may be displaced along a narrow sidewall of a box shaped housing. A partition parallel with said sidewall bars the inlet of the opening when the dispenser is operated, and an opening serves as a dispensing opening when the drawer is displaced to align its through-going opening with the dispensing opening. The ends of the drawer are closed by trough shaped shells, the shell at the one end being at its end opposite the drawer hinged to the housing, and being at its end adjacent to the drawer hinged to the drawer, and the end of the housing adjacent to the hinged shell being obliquely cut, so that the narrow side of the housing adjacent to the hinge hinging the shell to the housing is longer than the narrow sidewall forming the sliding surface for the drawer.

1 Claim, 1 Drawing Sheet

FIG. 1
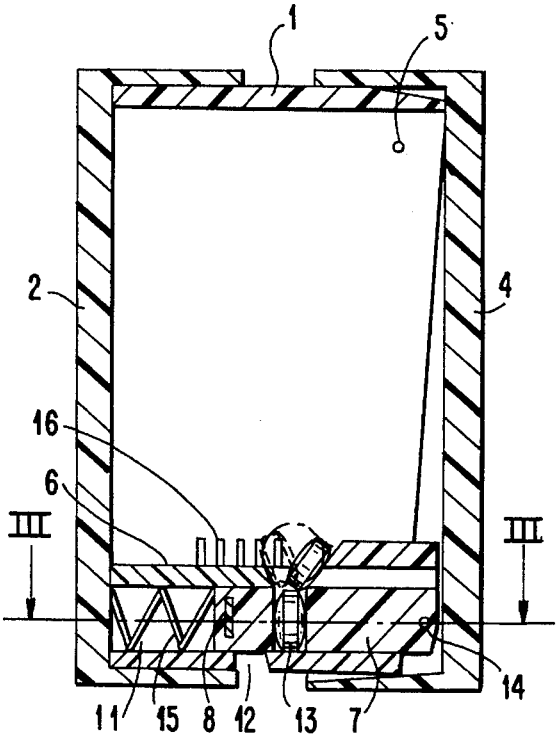
FIG. 2
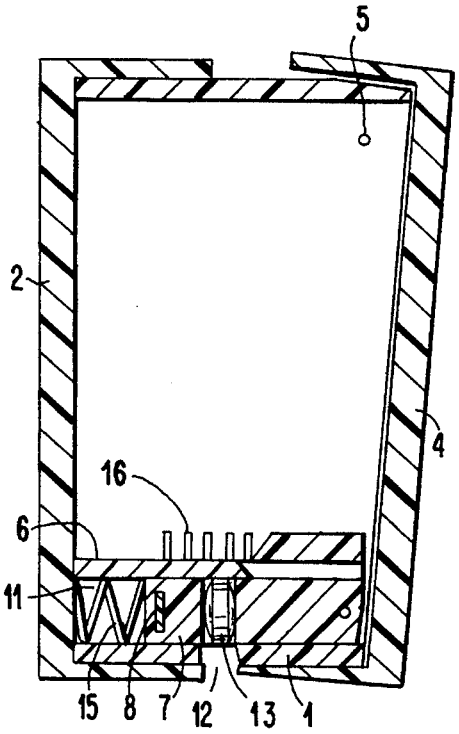
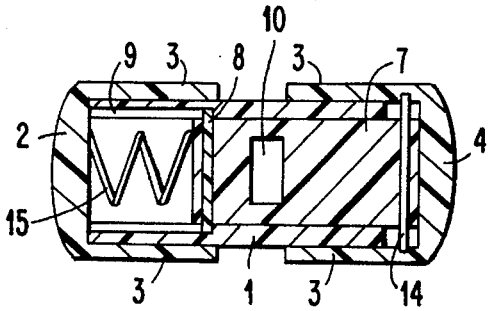
FIG. 3

TABLET DISPENSER

CROSS-REFERENCE TO RELATED APPLICATIONS

This application is a continuation of PCT/DK92/00361 filed Dec. 2, 1992, which is incorporated herein by reference.

BACKGROUND OF THE INVENTION

1. Field of the Invention

The invention relates to dispensers for dispensing tablets one at a time from the dispenser wherein the tablets are stored in an unarranged way.

2. Description of Related Art

Dispensers are known wherein tablets are guided into a drawer which has no fixed bottom, but wherein the bottom is formed by a wall along which the drawer may be displaced. The drawer is so dimensioned that it may accommodate exactly one tablet. When the dispenser is operated, the drawer is sliding along the bottom wall under a wall covering the open upper side of the drawer so that the cavity of the drawer is barred from the part of the dispenser storing the tablets. When there is no access for further tablets to the drawer, this drawer is during its continued displacement passed over an opening in the bottom wall, through which opening the tablet in the drawer is dispensed.

The drawer is mainly operated by pressing a button forming or being connected to one end of the drawer. However, it is the object of the invention to provide a dispenser which is more easy to operate even by people suffering from reduced tactile motor function.

SUMMARY OF THE INVENTION

This is obtained by a dispenser, comprising a drawer element displaceable along a narrow side wall of a box shaped housing wherein a partition parallel with said side wall bars an inlet to a through-going opening in the drawer when the dispenser is operated, and an opening in said side wall serves as a dispensing opening when the dispenser is operated, which dispenser according to the invention is characterized in that the ends of the housing perpendicular to the direction of movement for the drawer are closed by trough shaped shells, the shell at one end of the housing being at its end opposite the drawer hinged to the housing and being at its end adjacent to the drawer hinged to the drawer, and the end of the housing adjacent to the hinged shell being obliquely cut, so that the narrow side of the housing adjacent to the hinge hinging the shell to the housing is longer than the narrow side wall forming the bottom of the drawer.

Such a dispenser may be grasped by the entire hand and be operated by tightening the grasp.

According to the invention, the housing may be made of a transparent material, and the trough shaped shells may be made of an opaque material. Thereby it is made possible to inspect the stock of tablets through the transparent part of the housing which is not covered by the sides of the trough shaped shells.

BRIEF DESCRIPTION OF THE DRAWING

The invention will now be explained with reference to the drawing, wherein

FIG. 1 shows a sectional side view of a tablet dispenser in its neutral position, FIG. 2 shows a sectional view as in FIG. 1 with the dispenser in its dispensing position, and FIG. 3 shows a sectional view along the line III—III in FIG. 1.

DETAILED DESCRIPTION OF THE INVENTION

FIG. 1 shows a tablet dispenser comprising a housing 1 having opposite open ends each closed by a trough shaped shell 2 and 4, the side walls 3 of the shells covering the walls of the housing so that only a narrow stripe of the housing walls is exposed along the middle of the housing. If the housing is manufactured from a transparent material, this stripe will appear as an inspection window, through which the stock of tablets may be inspected.

One of the shells 2 is welded or glued to the housing 1, whereas the other shell 4 is fixed to the housing by a shaft 5 about which the shell 4 may be rotated, the housing 1 and the shell 4 being appropriately bevelled to allow a limited rotational movement of the shell 4 fitted with its sidewalls 3 over the end of the housing.

At its lower end the housing 1 is provided with an internal partition delimiting a channel 11 receiving a drawer element 7 which is at its one end fixed to the movable shell 4 by a hinge 14, and at its other end acted upon by a spring 15 abutting the fixed shell 2, the drawer element and consequently the movable shell 4 being thereby forced into a position defined by a stop element 8 abutting the end of a slot 9 provided in the wall of the housing. In this initial position the bottoms of the shells 2 and 4 will be parallel, and the dispenser will appear with a regular box shaped contour.

The drawer element 7 is provided with a through-going opening 10 having a size just allowing it to accommodate one tablet standing on its edge. In the initial position of the drawer the opening 10 is in alignment with an opening in the partition 6, but is at its other lower end closed by the lower wall of the housing. The opening in the partition 6 is inside the housing surrounded by guiding elements 16 guiding a tablet from the stock in the housing down into the opening 10 in the drawer element 7.

When the lower end of the shell 4 is pressed towards the housing 1, the drawer element 7 is pressed inward in the channel 11, until its through-going opening 10 is aligned with an opening 12 in the lower wall of the housing 1. At this time the tablet 13 in the drawer will drop out through the opening 12. When the shell 4 is released, it will together with the drawer be passed back into its initial position with the now emptied opening 10 lying beneath the opening in the partition 6, and a new tablet will drop into the opening 10 of the drawer element.

We claim:

1. A dispenser for tablets, comprising a box-shaped housing having a first and a second narrow side wall, a first and a second broad side wall, a first and a second open end, a partition parallel with the first and second narrow side walls, a drawer element displaceable between the second narrow side wall and the partition, wherein the partition bars an inlet to a through-going opening of the drawer element when the dispenser is operated, and the second narrow side wall has an opening serving as a dispensing opening when the through-going opening of the drawer element aligns with this opening during operation of the dispenser, a first and a second trough-shaped shell closing the first and second open ends of the box-shaped housing, respectively, wherein the first trough-shaped shell is rigidly secured to the box-shaped housing and the trough-shaped second shell, having a first and a second end, which is hinged at the first end to the box-shaped housing and is hinged at the second end to the drawer element, wherein the second open end of the box-shaped housing is obliquely cut so that the first narrow side wall adjacent to the hinging of the second shell to the housing is longer than the second narrow side wall.

* * * * *